US010119298B2

(12) United States Patent
Choi

(10) Patent No.: US 10,119,298 B2
(45) Date of Patent: Nov. 6, 2018

(54) CONVENIENT TENT

(71) Applicant: Campvalley (Xiamen) Co., Ltd., Xiamen (CN)

(72) Inventor: Kwan Jun Choi, Xiamen (CN)

(73) Assignee: Campvalley (Xiamen) Co., LTD., Xiamen (CN)

( * ) Notice: Subject to any disclaimer, the term of this patent is extended or adjusted under 35 U.S.C. 154(b) by 0 days.

(21) Appl. No.: 15/820,949

(22) Filed: Nov. 22, 2017

(65) Prior Publication Data

US 2018/0187448 A1 Jul. 5, 2018

(30) Foreign Application Priority Data

Dec. 29, 2016 (CN) ..... 2016 2 1469208 U

(51) Int. Cl.
*E04H 15/48* (2006.01)
*E04H 15/64* (2006.01)
*E04H 15/40* (2006.01)

(52) U.S. Cl.
CPC ..... *E04H 15/48* (2013.01); *E04H 15/405* (2013.01); *E04H 15/64* (2013.01)

(58) Field of Classification Search
CPC ..... E04H 15/32; E04H 15/34; E04H 15/36; E04H 15/40; E04H 15/48; E04H 15/52
See application file for complete search history.

(56) References Cited

U.S. PATENT DOCUMENTS

| | | | |
|---|---|---|---|
| 14,655 | A | 4/1856 | Hartwell |
| 58,283 | A | 9/1866 | Palmer |
| 379,274 | A | 3/1888 | Hamilton |
| 1,061,547 | A | 5/1913 | Kennedy et al. |
| 1,347,107 | A | 7/1920 | McCann |
| 2,113,118 | A | 4/1938 | Pyatt |
| 2,306,706 | A | 12/1942 | Lucas |
| 2,448,895 | A | 9/1948 | Lawrence |
| 2,530,765 | A | 11/1950 | Greenup |
| 2,555,220 | A | 5/1951 | Brown, Jr. |
| 2,627,865 | A | 2/1953 | Mitchell et al. |

(Continued)

FOREIGN PATENT DOCUMENTS

| | | |
|---|---|---|
| CA | 2022369 A1 | 2/1991 |
| CN | 1030790 C | 1/1996 |

(Continued)

*Primary Examiner* — David R Dunn
*Assistant Examiner* — Danielle Jackson
(74) *Attorney, Agent, or Firm* — Morgan, Lewis & Bockius LLP

(57) ABSTRACT

A tent includes a tent cloth, first coupling pieces disposed spatially around a middle portion of the tent cloth, and second coupling pieces disposed spatially around a lower portion of the tent cloth. The tent also includes an upper support and side supports. The upper support includes a first connector disposed at the upper portion of the tent cloth, and upper poles coupled with the first connector and the first coupling pieces. Each side support includes a second connector disposed at the lower portion of the tent cloth between two adjacent second coupling pieces, and three side poles each coupled with the second connector at one end portion and with a corresponding first coupling piece or one of the two adjacent second coupling pieces at the other end portion.

19 Claims, 5 Drawing Sheets

(56) References Cited

U.S. PATENT DOCUMENTS 2,716,993 A 9/1955 Codrick
2,731,972 A 1/1956 Braun
2,948,287 A 8/1960 Rupert
2,960,993 A 11/1960 Holmstrom
2,962,034 A 11/1960 Finlayson
2,984,249 A 5/1961 Sears, Jr. et al.
3,054,413 A 9/1962 Eshelman
3,171,417 A 3/1965 Stokes
3,333,373 A 8/1967 Taylor et al.
3,454,021 A 7/1969 Morris
3,513,861 A 5/1970 Johnson
3,738,378 A 6/1973 Williams
3,766,932 A * 10/1973 Sidis ..... E04B 1/1903 135/147
3,810,482 A * 5/1974 Beavers ..... E04H 15/48 135/147
3,838,703 A * 10/1974 Zeigler ..... E04B 1/3441 135/136
3,896,831 A 7/1975 Feldman et al.
3,929,146 A 12/1975 Maiken
3,941,140 A * 3/1976 Beavers ..... E04H 15/32 135/147
4,026,312 A * 5/1977 Beavers ..... E04H 15/48 135/120.4
4,077,417 A 3/1978 Beavers
4,148,332 A 4/1979 Huddle
4,201,237 A 5/1980 Watts et al.
4,280,521 A 7/1981 Zeigler
4,285,354 A 8/1981 Beavers
4,627,210 A 12/1986 Beaulieu
4,637,748 A 1/1987 Beavers
4,750,509 A 6/1988 Kim
4,787,182 A 11/1988 Serge
4,819,680 A * 4/1989 Beavers ..... E04H 15/32 135/119
4,838,003 A 6/1989 Zeigler
4,941,499 A * 7/1990 Pelsue ..... E04H 15/42 135/125
4,944,321 A 7/1990 Moyet-Ortiz
4,971,090 A 11/1990 Uhl
4,998,552 A * 3/1991 Niksic ..... E04B 1/3441 135/136
5,069,572 A * 12/1991 Niksic ..... E04H 15/425 135/147
5,293,890 A 3/1994 Park et al.
5,328,286 A 7/1994 Lee
5,333,634 A 8/1994 Taylor
5,361,794 A 11/1994 Brady
5,423,341 A 6/1995 Brady
5,617,681 A 4/1997 Lyons
5,628,338 A * 5/1997 Stumbo ..... E04H 15/40 135/147
5,634,483 A 6/1997 Gwin
5,666,986 A 9/1997 Fox
5,732,726 A 3/1998 Lee
5,797,695 A 8/1998 Prusmack
5,884,646 A 3/1999 Ju
5,943,837 A 8/1999 Esser et al.
6,021,795 A 2/2000 Long et al.
6,032,430 A 3/2000 Soukup
6,167,898 B1 1/2001 Larga et al.
6,286,530 B1 9/2001 Hussey
6,296,415 B1 10/2001 Johnson et al.
6,463,948 B2 10/2002 Lee
6,516,823 B1 2/2003 Glover et al.
6,591,571 B2 7/2003 Fritsche et al.
6,604,844 B2 8/2003 Hussey
6,666,223 B2 12/2003 Price et al.
6,772,780 B2 8/2004 Price
6,776,179 B1 8/2004 Chen
6,854,476 B1 2/2005 Chai
6,868,858 B2 3/2005 Suh
6,874,519 B2 4/2005 Chiang
6,892,744 B2 5/2005 Feldpausch et al.
7,025,075 B2 4/2006 Suh
7,040,585 B2 5/2006 Cheng et al.
7,059,094 B2 6/2006 Yamawaki
D544,941 S 6/2007 Rogers
7,311,113 B2 12/2007 Suh
7,316,239 B2 1/2008 Yang
7,320,332 B2 * 1/2008 Reis ..... E04H 15/44 135/115
RE40,544 E 10/2008 Suh
7,481,235 B2 1/2009 Prusmack
7,546,845 B2 6/2009 Prusmack
D705,884 S 5/2014 Jin
8,910,648 B2 12/2014 Jin
9,163,425 B1 * 10/2015 Kubica ..... E04H 15/32
9,598,876 B1 * 3/2017 LaHood ..... E04H 15/58
2001/0050098 A1 12/2001 Lee
2003/0005953 A1 1/2003 Erbetta et al.
2005/0039388 A1 * 2/2005 Wehner ..... A01G 9/16 47/17
2005/0100400 A1 * 5/2005 Fulcher ..... E04H 15/48 403/346
2006/0054208 A1 3/2006 Romano
2007/0051399 A1 3/2007 Jung
2007/0215192 A1 9/2007 Hoffman
2009/0084420 A1 * 4/2009 Pelsue ..... E04H 15/48 135/96
2010/0154282 A1 * 6/2010 Lau ..... A01M 31/025 43/1
2010/0269876 A1 * 10/2010 Schlipf ..... E04H 15/001 135/143
2011/0168221 A1 * 7/2011 Schlipf ..... E04H 15/001 135/143
2013/0008478 A1 * 1/2013 Prieto Estebanez .... E04H 15/48 135/147
2013/0014794 A1 1/2013 Jin
2013/0074894 A1 * 3/2013 Cook ..... E04H 15/54 135/96
2014/0261601 A1 9/2014 Jin
2014/0290710 A1 10/2014 Choi
2015/0083177 A1 3/2015 Hotes
2015/0250162 A1 * 9/2015 Wyant ..... E04H 15/001 135/147
2016/0208513 A1 * 7/2016 Ways ..... E04H 15/425

FOREIGN PATENT DOCUMENTS

CN 2506736 Y 8/2002
CN 2635827 Y 8/2004
CN 201129060 Y 10/2008
CN 202249138 U 5/2012
CN 203097418 U 7/2013
FR 1121851 A 8/1956
FR 68588 E 5/1958
GB 2201703 A 9/1988
GB 2259927 A 3/1993
GB 2273723 B 8/1997
GB 2482745 A 2/2012
WO WO 2011022764 A1 3/2011
WO WO 2011/047430 A1 4/2011

* cited by examiner

CONVENIENT TENT

CROSS-REFERENCE TO RELATED APPLICATION

The present application claims priority of Chinese Patent Application Number 201621469208.9 filed Dec. 29, 2016, the entire contents of which application are incorporated herein for all purposes by this reference.

FIELD OF THE INVENTION

The present invention generally relates to a tent, and more particularly, to a tent having a tent cloth coupled with supports.

BACKGROUND

There are various different types of tents with different structures and styles. Small and medium-sized tents are usually portable and for camping. Larger pavilion tents are used as sunshades. For use in some outdoor activities such as hunting, many tents are composed of a tent cloth supported by crossing poles. Such a tent is usually heavy and difficult to set up or take down, and thus is inconvenient to carry and use.

Given the above background, there is a need in the art for tents that address the above-mentioned problems.

The information disclosed in this Background section is provided for an understanding of the general background of the invention and is not an acknowledgement or suggestion that this information forms part of the prior art already known to a person skilled in the art.

SUMMARY

The present invention provides tents that are easy and simple to fold and unfold, and compact when folded.

In various exemplary embodiments, the present invention provides a tent including a tent cloth, a plurality of first coupling pieces, a plurality of second coupling pieces, an upper support and a plurality of side supports. The tent cloth includes an upper portion, a middle portion and a lower portion. The plurality of first coupling pieces is disposed spatially around the middle portion of the tent cloth. The plurality of second coupling pieces is disposed spatially around the lower portion of the tent cloth. The upper support includes a first connector disposed at the upper portion of the tent cloth and a plurality of upper poles. Each upper pole in the plurality of upper poles has a first end portion pivotally connected with the first connector and a second end portion coupled with a corresponding first coupling piece in the plurality of first coupling pieces. Each side support in the plurality of side supports corresponds to a respective upper pole in the plurality of upper poles, and includes a second connector and first, second and third side poles. The second connector is disposed at the lower portion of the tent cloth between two adjacent second coupling pieces in the plurality of second coupling pieces. Each of the first, second and third side poles has a first end portion pivotally connected with the second connector, and a second end portion coupled with the corresponding first coupling piece or one of the two adjacent second coupling pieces.

In many exemplary embodiments, the plurality of first coupling pieces and the plurality of second coupling pieces are fixed at an interior side of the tent cloth. In some exemplary embodiments, the first connector of the upper support is fixed at an interior side of the tent cloth by a first fastener, and at least a portion of the first fastener is exposed to an exterior side of the tent cloth to facilitate easy folding and unfolding of the tent. In some exemplary embodiments, the second connector of each side support in the plurality of side supports is fixed at an interior side of the tent cloth by a second fastener, and at least a portion of the second fastener is exposed to an exterior side of the tent cloth to facilitate easy folding and unfolding of the tent.

In some exemplary embodiments, a respective first coupling piece in the plurality of first coupling pieces is a sleeve, a tube, a slot, or a sheath; and the second end portion of a corresponding upper pole and the second end portion of a corresponding side pole are inserted into the respective first coupling piece from opposite sides of the respective first coupling piece. In some exemplary embodiments, a respective first coupling piece in the plurality of first coupling pieces includes a first portion to couple with the second end portion of a corresponding upper pole and a second portion to couple with the second end portion of a corresponding side pole.

In some exemplary embodiments, a respective second coupling piece in the plurality of second coupling pieces is a sleeve, a tube, a slot, or a sheath; and the second end portions of corresponding side poles of two adjacent side supports are inserted into the respective second coupling piece from opposite sides of the respective second coupling piece. In some exemplary embodiments, a respective second coupling piece in the plurality of second coupling pieces includes a first portion and a second portion to couple with the second end portions of corresponding side poles of two adjacent side supports.

In some exemplary embodiments, the plurality of upper poles is disposed evenly and circumferentially around the first connector, and the plurality of first coupling pieces is disposed evenly and circumferentially around the middle portion of the tent cloth. In some exemplary embodiments, the plurality of second coupling pieces is disposed evenly and circumferentially around the lower portion of the tent cloth.

In many exemplary embodiments, the number of the side supports is the same as the number of the upper poles. In some exemplary embodiments, the plurality of upper poles includes three, four, five, six, seven, eight or more upper poles.

In some exemplary embodiments, the tent cloth includes an opening to serve as an entrance to an interior of the tent.

In many exemplary embodiments, the tent cloth includes a plurality of side cloths. Each side cloth includes a first side edge and a second side edge. The first side edge of each side cloth is coupled with the second side edge of an adjacent side cloth to form a seam. In some exemplary embodiments, each side cloth in the plurality of side cloths has a substantially triangular shape, and the first connector is disposed at an apex of the tent cloth. In an exemplary embodiment, at least one of the side cloths includes an opening to serve as an entrance to an interior of the tent.

In some exemplary embodiments, a first coupling piece in the plurality of first coupling pieces is disposed at or proximal to a middle portion of the seam, and the second connector of a side support in the plurality of side supports is disposed at a lower portion of the seam. In an exemplary embodiment, a first coupling piece in the plurality of first coupling pieces is disposed at and aligned with the seam.

In some exemplary embodiments, each side cloth in the plurality of side cloths further includes a bottom edge, wherein a second coupling piece in the plurality of second coupling pieces is disposed at or proximal to a middle portion of the bottom edge.

In an exemplary embodiment, the tent cloth further includes a plurality of bottom cloths coupled with the plurality of side cloths.

The tents of the present invention have other features and advantages that will be apparent from or are set forth in more detail in the accompanying drawings, which are incorporated herein, and the following Detailed Description, which together serve to explain certain principles of the present invention.

BRIEF DESCRIPTION OF THE DRAWINGS

The accompanying drawings, which are incorporated into and constitute a part of this specification, illustrate one or more embodiments of the present application and, together with the detailed description, serve to explain the principles and implementations of the application.

DETAILED DESCRIPTION

Figure 1:
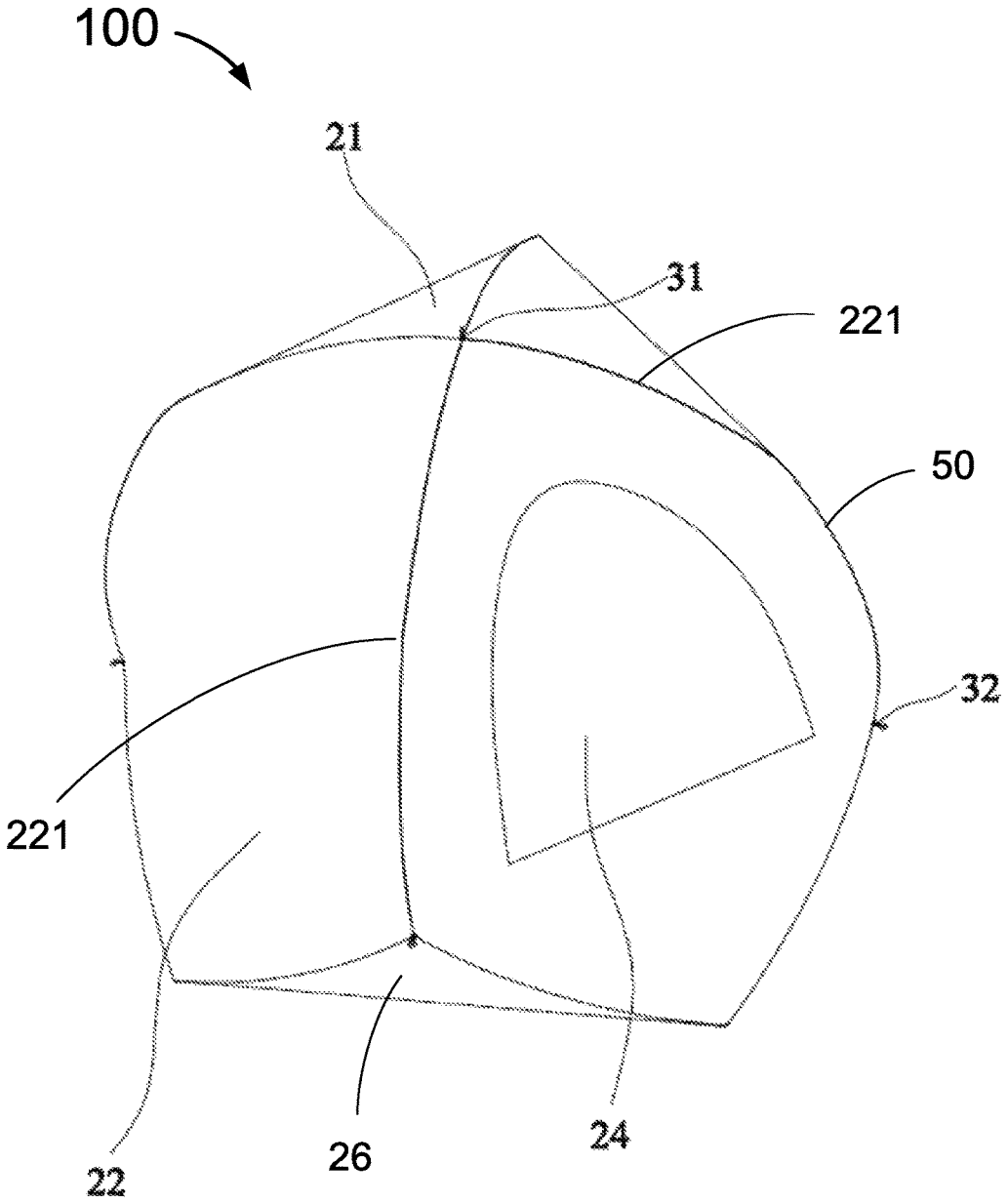
FIG. 1 is a schematic diagram illustrating an exterior of an exemplary tent in an unfolded state according to some exemplary embodiments of the present invention.

Reference will now be made in detail to implementations of the present invention as illustrated in the accompanying drawings. The same reference indicators will be used throughout the drawings and the following detailed description to refer to the same or like parts. Those of ordinary skill in the art will realize that the following detailed description of the present invention is illustrative only and is not intended to be in any way limiting. Other embodiments of the present invention will readily suggest themselves to such skilled persons having benefit of this disclosure.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Many modifications and variations of this disclosure can be made without departing from its spirit and scope, as will be apparent to those skilled in the art. The specific embodiments described herein are offered by way of example only, and the disclosure is to be limited only by the terms of the appended claims, along with the full scope of equivalents to which such claims are entitled.

Embodiments of the present invention are described in the context of tents. Generally, a tent of the present invention includes an upper support, a plurality of side supports, and a tent cloth coupled with the upper and side supports through a plurality of coupling pieces disposed at the tent cloth. The tent can be of any suitable shapes including but not limited to triangular, quadrangular, pentagonal, hexangular, heptagonal or octagonal shape. The tent can also be of any suitable sizes to accommodate one, two, three, four, or more people. Folding and unfolding a tent of the present invention is easy and simple. When folded, the tent is compact and thus convenient to carry around.

Referring to FIGS. 1-5, there is depicted an exemplary tent in accordance with some embodiments of the present invention. As shown, exemplary tent 100 includes a tent cloth, an upper support and a plurality of side supports such as tent cloth 50, upper support 60 and side supports 70. Herein, the combination of the upper and side supports is generally referred to as a frame or a tent frame, and designated with reference numeral 10.

Upper support 60 includes first connector 31 and a plurality of upper poles 11. In many embodiments, the number of upper poles 11 and the number of side supports 70 are the same. That is, for each respective upper pole, there is a corresponding side support, and vice versa. The number of upper poles 11 and the number of side supports 70 can be three, four, five, sixth, seven, eight or more as long as they are the same.

Each upper pole 11 has a first end portion and a second end portion, with the first end portion pivotally connected with the first connector. In some embodiments, the first end portions of the upper poles are uniformly and circumferentially disposed along the first connector. It should be noted that the upper poles can be but does not necessarily have to be the same as each other in terms of the length or other configurations.

Side support 70 includes second connector 32 and first, second and third side poles 12. Each of the first, second and third side poles 12 has a first end portion and a second end portion, with the first end portion pivotally connected with the second connector. Like the upper poles, the side poles can be but do not necessarily have to be the same as each other in terms of the length or other characteristics/configurations. Also, the side poles can be but do not necessarily have to be the same as the upper poles in terms of the length or other characteristics/configurations.

Tent cloth 50 has an upper portion such as upper portion 21, a lower portion (e.g., a portion of the tent cloth adjacent a ground at which the tent is setup for use), and a middle portion between the upper and lower portions. In many embodiments, tent cloth 50 includes a plurality of side cloths 22 formed or coupled (e.g., stitched) with each other. For instance, FIG. 1 illustrates each side cloth 22 has two or more side edges, in which the proximal edges of two adjacent side cloths are coupled (e.g., stitched) with each other to form a seam such as seam 221.

Tent cloth 50 can include any suitable number of side cloths 22 such as three, four, fix, six, seven, eight or more side cloths 22. The number of side cloths 22 can be but does not necessarily have to be the same as the number of upper poles 11 and the number of side supports 70. In some embodiments, each side cloth 22 has a substantially triangular shape. When coupled with each other, the triangular shaped side cloths converge at the top (e.g., an apex) of the tent cloth. In FIG. 1, the apex of the tent cloth corresponds to the position at which reference numeral 31 points.

Figure 2:
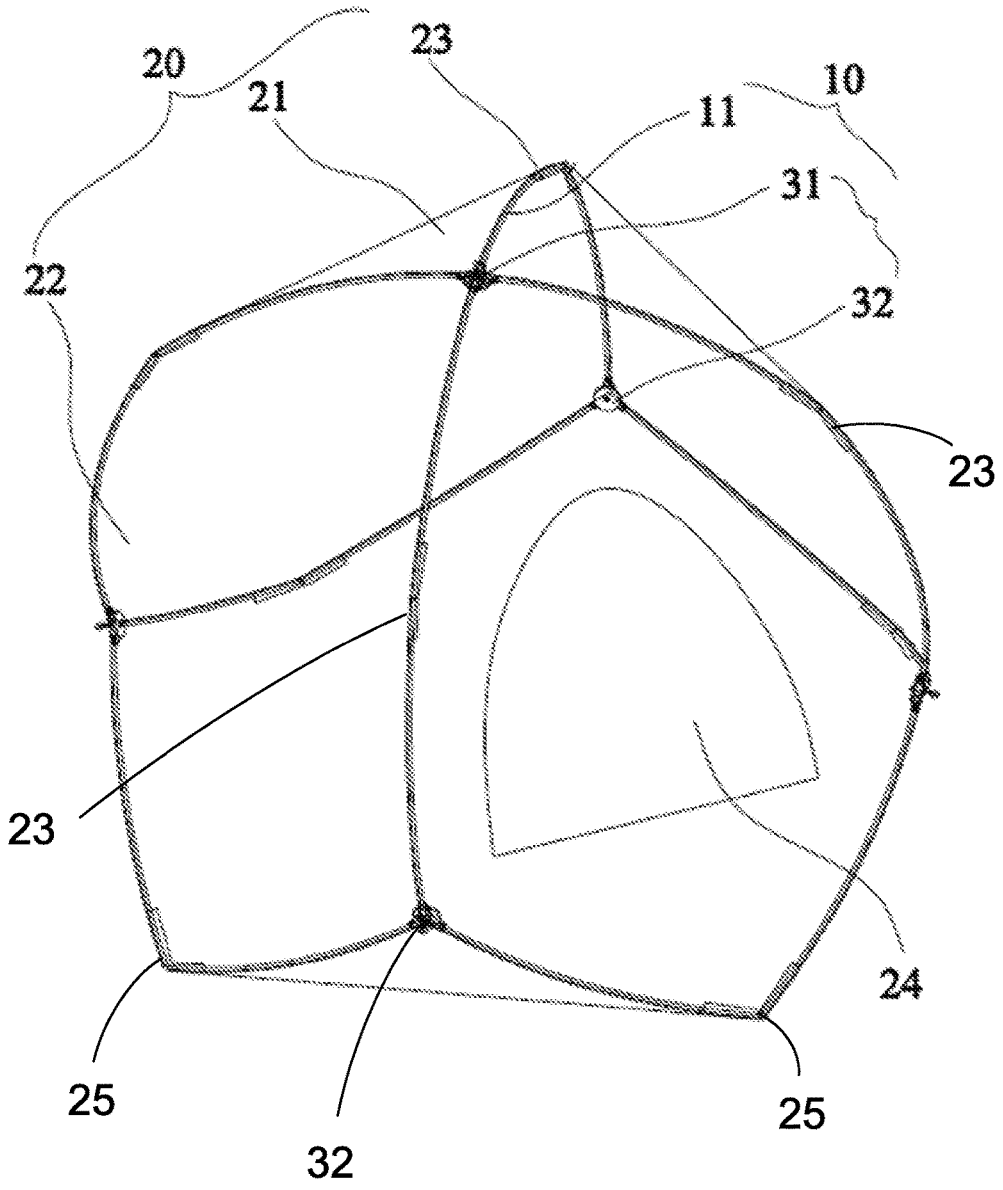
FIG. 2 is a schematic diagram illustrating a structure of the tent of FIG. 1.
Figure 3:
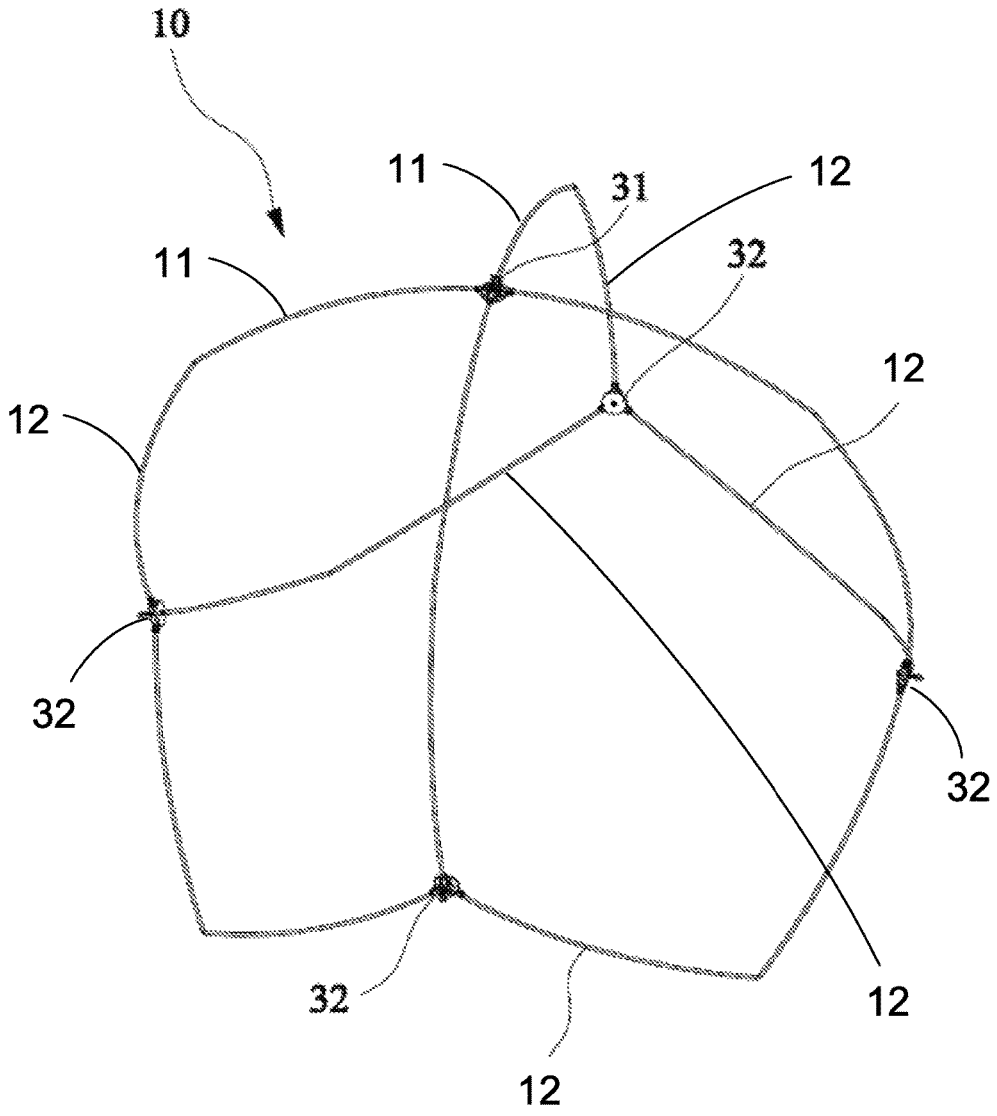
FIG. 3 is a schematic diagram illustrating a frame of the tent of FIG. 1.
Figure 4:
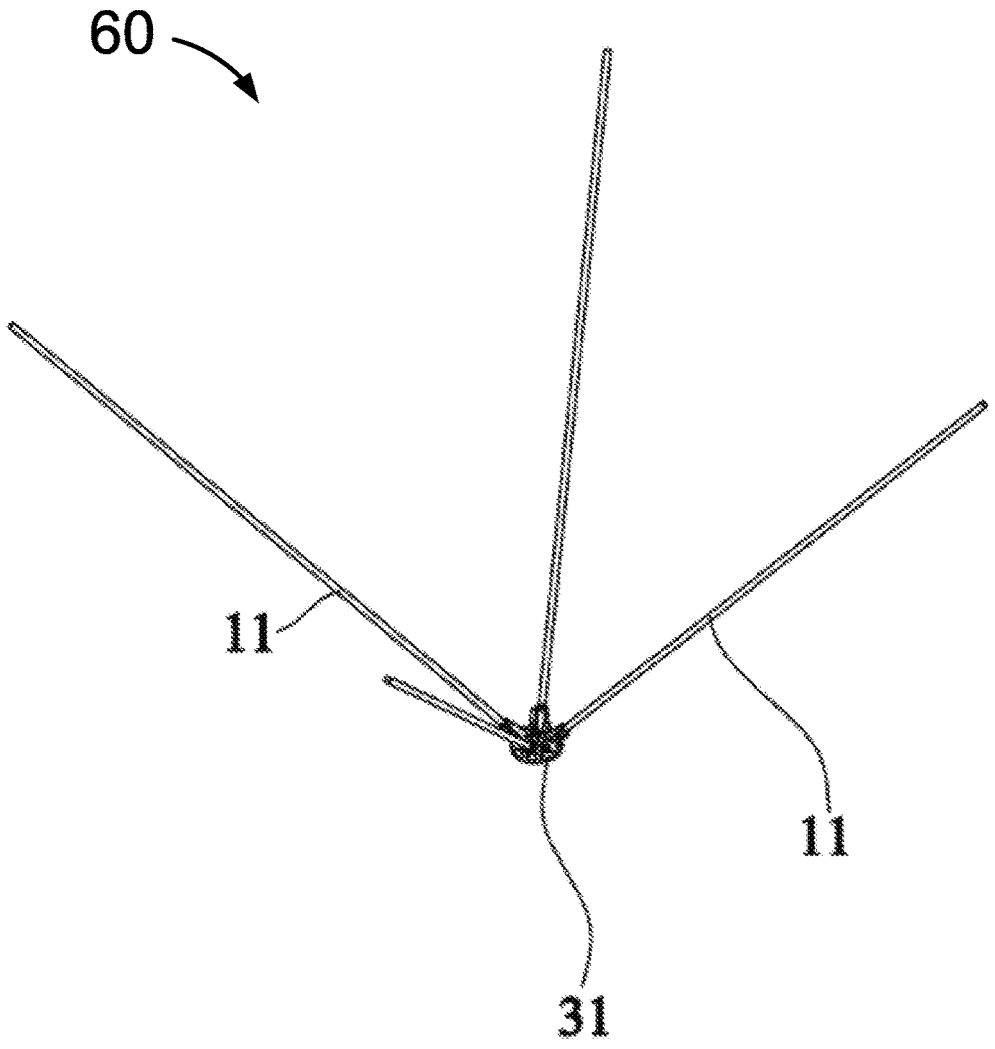
FIG. 4 is a schematic diagram illustrating an upper support of the frame of FIG. 3.
Figure 5:
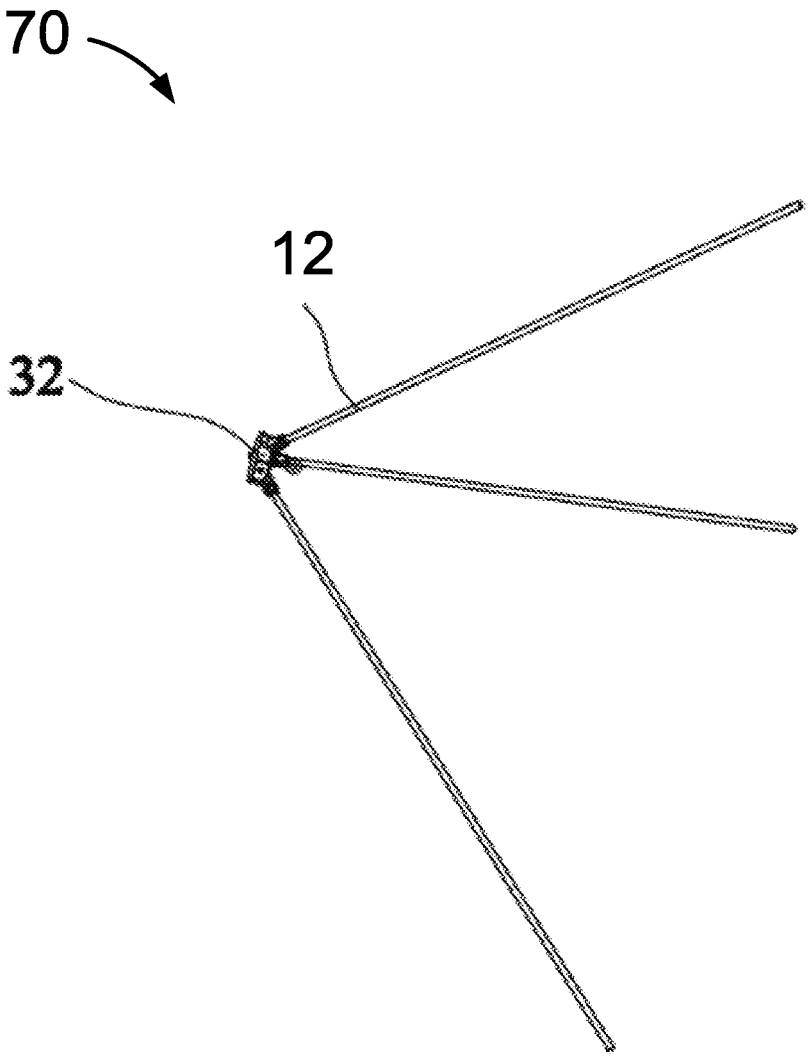
FIG. 5 is a schematic diagram illustrating a side support of the frame of FIG. 3.

In some embodiments, tent cloth 50 is formed with at least one opening to serve as an entrance or ventilation. By way of example, FIGS. 1 and 2 illustrate one side cloth 22 formed with opening 24 serving as an entrance to the interior of the tent.

In some embodiments, tent cloth 50 includes alternative, additional or optional cloths. For instance, in an embodiment, tent cloth 50 further includes a plurality of bottom cloths such as bottom cloth 26 coupled with the plurality of side cloths 22.

To couple the tent cloth with the upper and side supports, a plurality of coupling pieces such as first coupling pieces 23 and second coupling pieces 25 is disposed at the tent cloth, e.g., formed or fixedly coupled with the tent cloth by stitching, gluing, fastening or the like. In various embodiments, first coupling pieces 23 and second coupling pieces 25 are fixed at an interior side of the tent cloth such that when coupled the frame is disposed inside of the tent. Herein, the combination of the tent cloth and the coupling pieces is generally referred to as a cover or a tent cover, and designated with reference numeral 20.

First coupling piece 23 and second coupling piece 25 can be the same as or different from each other, and can have any suitable configuration including but not limited to a sleeve, a tube, a slot, a sheath or the like. They can be made of fabric, plastics or other proper material. In some embodiments, first coupling piece 23 and second coupling piece 25 are fabric sleeves stitched onto the tent cloth or with the seams of the tent cloth. In an embodiment, first coupling piece 23 or second coupling piece 25 is stitched with a seam, with at least a portion of the first or second coupling piece disposed within, above or below the seam.

In many embodiments, first coupling pieces 23 are disposed spatially, and in some cases they are spaced evenly and circumferentially, around the middle portion of the tent cloth. In some embodiments, first coupling piece 23 is disposed at or proximal to a middle portion of seam 221, for instance, by stitching the first coupling piece with the seam or on the tent cloth at a position proximal to the seam. In an embodiment, first coupling piece 23 is disposed at seam 221 and aligned with seam 221.

Similarly, in many embodiments, second coupling pieces 25 are disposed spatially, and in some cases they are spaced evenly and circumferentially, around the lower portion of the tent cloth. In some embodiments, second coupling piece 25 is disposed at or proximal to a bottom edge of side cloth 22.

In many embodiments, first connector 31 of the upper support is disposed at the upper portion of the tent cloth, for example, fixed at the upper portion of the tent cloth by a fastener (e.g., a bolt, a screw). In some embodiments, first connector 31 is disposed at the top or the apex of the tent cloth. In some embodiments, the fastener or a portion of the fastener is exposed outside of the tent cloth as illustrated in FIG. 1. The exposure of the fastener allows one to hold the fastener, making it easy and convenient to fold and unfold the tent.

With the first end portion pivotally connected with the first connector, each respective upper pole 11 has its second end portion coupled with a corresponding first coupling piece 23. In embodiments where the first coupling piece is a sleeve, a tube, a slot, a sheath or the like, the second end portion of the respective upper pole is inserted into the corresponding first coupling piece.

In many embodiments, each respective second connector 32 is disposed at the lower portion of the tent cloth between two adjacent second coupling pieces, and below a corresponding first coupling piece, for instance, at a lower portion of seam 221. In some embodiments, second connector 32 is disposed at a bottom edge of side cloth 22. Like first connector 31, second connector 32 can be fixed at the tent cloth by a fastener (e.g., a bolt, a screw), and the fastener or a portion of the fastener of second connector 32 can be exposed outside of the tent cloth as illustrated in FIG. 1. The exposure of the fastener of second connector 32 also facilitates easy folding and unfolding of the tent.

As disclosed herein, each of the first, second and third side poles has a first end portion and a second end portion, with the first end portion pivotally connected with the second connector. Among the first, second and third side poles, one (e.g., the first) side pole has the second end portion coupled with one of the two adjacent second coupling pieces, one (e.g., the second) side pole has the second end portion coupled with the corresponding first coupling piece, and one (e.g., the third) side pole has the second end portion coupled with the other of the two adjacent second coupling pieces. In embodiments where the first or second coupling piece is a sleeve, a tube, a slot, a sheath or the like, the second end portion of the one side pole is inserted into the first or second coupling piece.

In some embodiments, first coupling piece 23 includes first and second coupling portions, one for coupling with the second end portion of the corresponding upper pole and the other for coupling with the second end portion of the corresponding side pole. Similarly, in some embodiments, second coupling piece 25 includes first and second coupling portions, one for coupling with the second end portion of the corresponding side poles of the two adjacent side supports. In an embodiment, each of the first and second coupling pieces includes first and second portions as illustrated in FIG. 2.

With the cover and the frame coupled with each other, folding and unfolding the tent of the present invention is easy and simple. For instance, folding the tent can be achieved by pushing first connector 31 and second connectors 32 toward each other (e.g., holding the fasteners of first connector 31 and second connectors 32 and pushing them toward each other). Reversing this action unfolds the tent.

The terminology used herein is for the purpose of describing particular implementations only and is not intended to be limiting of the claims. As used in the description of the implementations and the appended claims, the singular forms "a", "an" and "the" are intended to include the plural forms as well, unless the context clearly indicates otherwise. It will be understood that, although the terms "first," "second," etc. may be used herein to describe various elements, these elements should not be limited by these terms. These terms are only used to distinguish one element from another. For example, a first connector could be termed a second connector, and, similarly, a second connector could be termed a first connector, without changing the meaning of the description, so long as all occurrences of the "first connector" are renamed consistently and all occurrences of the "second connector" are renamed consistently.

What is claimed is:

1. A tent comprising:

a tent cloth comprising an upper portion, a middle portion and a lower portion;

a plurality of first coupling pieces disposed spatially around the middle portion of the tent cloth;

a plurality of second coupling pieces disposed spatially around the lower portion of the tent cloth;

an upper support comprising a first connector disposed at the upper portion of the tent cloth and a plurality of upper poles, wherein each upper pole in the plurality of upper poles has a first end portion pivotally connected with the first connector and a second end portion coupled with a corresponding first coupling piece in the plurality of first coupling pieces; and a plurality of side supports, each corresponding to a respective upper pole in the plurality of upper poles, and comprising a second connector and first, second and third side poles, wherein the second connector is disposed at the lower portion of the tent cloth between two adjacent second coupling pieces in the plurality of second coupling pieces, and wherein each of the first, second and third side poles has a first end portion pivotally connected with the second connector, and a second end portion coupled with the corresponding first coupling piece or one of the two adjacent second coupling pieces, such that in an unfolded state, the two side poles coupled with the two adjacent second coupling pieces are positioned on two opposite sides of a plane defined by the first connector, the corresponding first coupling piece, and the second connector; wherein the plurality of first coupling pieces and the plurality of second coupling pieces are fixed at an interior side of the tent cloth.

2. The tent of claim 1, wherein the first connector of the upper support is fixed at an interior side of the tent cloth by a first fastener, at least a portion of which is exposed to an exterior side of the tent cloth to facilitate easy folding and unfolding of the tent.

3. The tent of claim 1, wherein the second connector of each side support in the plurality of side supports is fixed at an interior side of the tent cloth by a second fastener, at least a portion of which is exposed to an exterior side of the tent cloth to facilitate easy folding and unfolding of the tent.

4. The tent of claim 1, wherein a respective first coupling piece in the plurality of first coupling pieces is a sleeve, a tube, a slot, or a sheath, wherein the second end portion of a corresponding upper pole and the second end portion of a corresponding side pole are inserted into the respective first coupling piece from opposite sides of the respective first coupling piece.

5. The tent of claim 1, wherein a respective first coupling piece in the plurality of first coupling pieces comprises a first portion to couple with the second end portion of a corresponding upper pole and a second portion to couple with the second end portion of a corresponding side pole.

6. The tent of claim 1, wherein a respective second coupling piece in the plurality of second coupling pieces is a sleeve, a tube, a slot, or a sheath, wherein the second end portions of corresponding side poles of two adjacent side supports are inserted into the respective second coupling piece from opposite sides of the respective second coupling piece.

7. The tent of claim 1, wherein a respective second coupling piece in the plurality of second coupling pieces comprises a first portion and a second portion to couple with the second end portions of corresponding side poles of two adjacent side supports.

8. The tent of claim 1, wherein the plurality of upper poles is disposed evenly and circumferentially around the first connector, and the plurality of first coupling pieces is disposed evenly and circumferentially around the middle portion of the tent cloth.

9. The tent of claim 1, wherein the plurality of second coupling pieces is disposed evenly and circumferentially around the lower portion of the tent cloth.

10. The tent of claim 1, wherein the number of the side supports is the same as the number of the upper poles.

11. The tent of claim 1, wherein the plurality of upper poles comprises three, four, five, six, seven, eight or more upper poles.

12. The tent of claim 1, wherein the tent cloth comprises an opening to serve as an entrance to an interior of the tent.

13. The tent of claim 1, wherein the tent cloth comprises a plurality of side cloths, wherein each side cloth comprises a first side edge and a second side edge, and the first side edge of each side cloth is coupled with the second side edge of an adjacent side cloth to form a seam.

14. The tent of claim 13, wherein each side cloth in the plurality of side cloths has a substantially triangular shape, and the first connector is disposed at an apex of the tent cloth.

15. The tent of claim 13, wherein the tent cloth further comprises a plurality of bottom cloths coupled with the plurality of side cloths.

16. The tent of claim 13, wherein a first coupling piece in the plurality of first coupling pieces is disposed at or proximal to a middle portion of the seam, and the second connector of a side support in the plurality of side supports is disposed at a lower portion of the seam.

17. The tent of claim 13, wherein a first coupling piece in the plurality of first coupling pieces is disposed at and aligned with the seam.

18. The tent of claim 13, wherein each side cloth in the plurality of side cloths further comprises a bottom edge, wherein a second coupling piece in the plurality of second coupling pieces is disposed at or proximal to a middle portion of the bottom edge.

19. The tent of claim 13, wherein at least one of the side cloths comprises an opening to serve as an entrance to an interior of the tent.

* * * * *